US005803333A

United States Patent [19]

Fawcett

[11] Patent Number: 5,803,333

[45] Date of Patent: Sep. 8, 1998

[54] PACK WITH EASY-ACCESS POCKET

[75] Inventor: Roger R. Fawcett, Weatherford, Tex.

[73] Assignee: FasTrak Systems, Inc., Weatherford, Tex.

[21] Appl. No.: 698,565

[22] Filed: Aug. 14, 1996

[51] Int. Cl.[6] ..... A45F 5/00

[52] U.S. Cl. ..... 224/652; 224/148.2; 224/148.5; 224/655; 224/659; 224/236

[58] Field of Search ..... 224/575, 578, 224/579, 580, 160, 191, 627, 628, 645, 650, 651, 652, 654–659, 660, 663, 664, 676, 680, 681, 230, 235, 236, 250, 904, 919, 148.2, 148.5; 2/247, 250, 252, 94; 383/117, 38, 39, 40, 100, 102; 24/468; 190/109, 111

[56] References Cited

U.S. PATENT DOCUMENTS

| | | | |
|---|---|---|---|
| 964,620 | 7/1910 | Dana | 2/252 |
| 1,404,163 | 1/1922 | Pim | 224/676 |
| 1,426,024 | 8/1922 | Thureson | 2/94 |
| 2,328,095 | 8/1943 | Phillips | 224/222 |
| 2,468,915 | 5/1949 | Bayless | 2/247 |
| 2,485,442 | 10/1949 | Halliday | 2/94 |
| 2,620,479 | 12/1952 | Buck | 2/94 |
| 2,755,480 | 7/1956 | Jones et al. | 2/94 |
| 4,153,092 | 5/1979 | Haslam | 224/655 |
| 4,420,097 | 12/1983 | Motsenbocker | 224/148.2 |
| 4,739,913 | 4/1988 | Moore | 224/652 |
| 5,142,702 | 9/1992 | Piloian | 2/250 |
| 5,288,150 | 2/1994 | Bearman | 383/38 |
| 5,400,934 | 3/1995 | Ducros | 224/627 |
| 5,407,112 | 4/1995 | Christodoulou et al. | 224/652 |

FOREIGN PATENT DOCUMENTS

| | | | |
|---|---|---|---|
| 1002897 | 3/1952 | France | 224/209 F |
| 693272 | 6/1940 | Germany | 224/209 F |
| 70698 | 1/1945 | Norway | 224/209 F |
| 180216 | 10/1935 | Switzerland | 224/209 F |
| 19546 | of 1903 | United Kingdom | 224/209 F |
| 323451 | 1/1930 | United Kingdom | 224/209 F |

*Primary Examiner*—Allan N. Shoap
*Assistant Examiner*—Gregory M. Vidovich
*Attorney, Agent, or Firm*—Kolisch, Hartwell, Dickinson, McCormack & Heuser

[57] ABSTRACT

A pack for wearing on a person's back, comprising a front facing outwardly when the pack is worn and a pocket attached to and extending at least partially across the front of the pack. The pocket overlies generally the small of the person's back when the pack is worn, and includes an open entrance defined by an upper edge oriented for readily being located by touch when the person reaches behind their back, thereby guiding and facilitating access into the pocket. The pocket preferably includes an upwardly extending pocket flap that provides the upper edge of the pocket.

12 Claims, 5 Drawing Sheets

Fig. 8
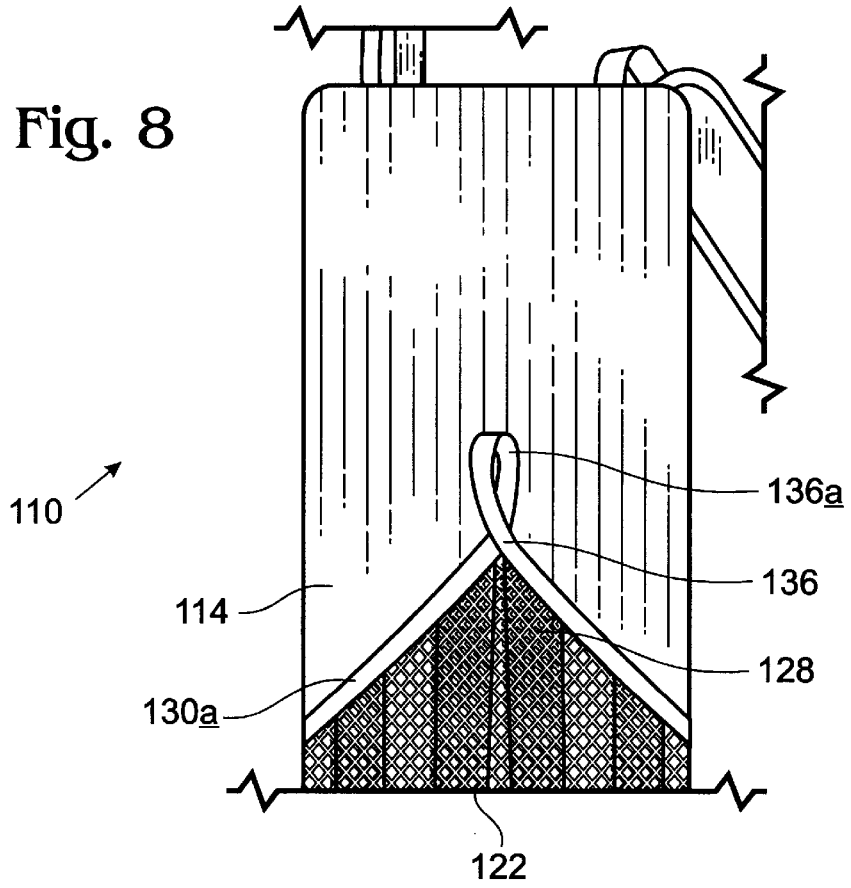
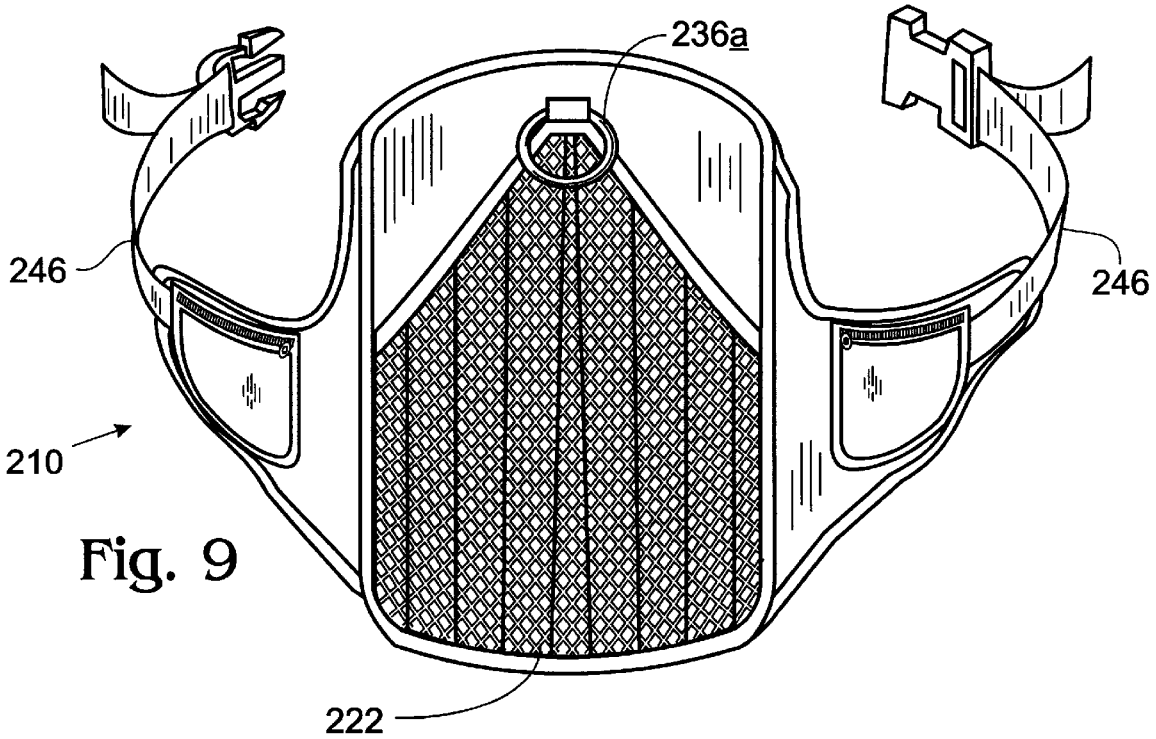
Fig. 9

PACK WITH EASY-ACCESS POCKET

FIELD OF THE INVENTION

This invention relates generally to packs and, more specifically, to a pack-mounted pocket with an opening that provides a person with easy access to the contents of the pocket while the pack is on the person's back.

BACKGROUND OF THE INVENTION

Packs, including packs with pockets, are well known. So are water bottles, canteens, bota bags, and other liquid-holding containers often used in association with packs and the types of physical activities for which packs are intended. In 1988, packs and water bottles were combined in an invention that developed into a highly successful product known as the CAMELBAK® hydration system. Specifically, through the use of a unique mouth-activated valve described in U.S. Pat. No. 5,085,349, a water bottle could be placed in a small, thin pack while allowing a person wearing the pack on their back to drink from the water bottle at will. The bottle was in the form of a thin, streamlined, flexible reservoir, and was carried in a sleek back-mounted pack.

Many people wear or carry a pack primarily to carry water while participating in an activity. With conventional water bottles, an effective pack is often quite bulky. Thus, packs incorporating a reservoir-style water bottle offered a dramatic change from previous style packs. These reservoir-receiving packs are used in virtually every type of outdoor activity, and some indoor activities. For example, reservoir-receiving packs are used for biking, hiking, windsurfing, kayaking, horseback-riding, skating, and even military maneuvers.

Despite the long existence of packs, including several years' existence of reservoir-receiving packs, no known pack has incorporated a feature that allows a person wearing the pack on their back easy access to non-liquid contents of the pack. For example, a person may want to reach food, tools, a map, compass, first aid kit, or other things without stopping to remove the pack. This is particularly the case in competitive activities such as mountain bike racing. Accordingly, there is a great need for a pack with an easy-access pocket or compartment.

SUMMARY OF THE INVENTION

The present invention incorporates and is designed for a reservoir-receiving pack, but should work equally well in larger, more bulky, conventional packs which are worn on the back. It includes a pocket attached to and extending at least partially across the front of a pack (the portion of a pack facing away from a person wearing the pack) with an open entrance for the pocket defined by an upper edge. The upper edge is oriented for being located readily by touch when a person wearing the pack reaches behind their back, thereby guiding the person's hand into the pocket. The upper edge serves as a "touch point" providing a guide to the entrance of the pocket.

Preferably, the pocket includes an upwardly extending pocket flap, and the open entrance includes a pair of oppositely facing openings defined by the edges of the pocket flap. Furthermore, a top flap preferably is attached to the pack adjacent a top of the pack and extends downwardly toward the pocket flap. The top flap then is connected operatively to the pocket flap, preferably by a flap strap and buckle. This interconnection maintains the top flap in a closed position while simultaneously maintaining the pocket flap in an upwardly oriented article-retaining position.

It is an object of the present invention to provide a pack that incorporates an easy-access pocket. It is a further object of the present invention to provide such a pack with a pocket that includes a pair of oppositely facing openings so that easy access is available from both sides of the pack. In this manner, a person wearing the pack may access the pocket with either their left or right hand. Additional objects and advantages of the present invention will be understood more readily after a consideration of the drawings and the Detailed Description of the Preferred Embodiment.

BRIEF DESCRIPTION OF THE DRAWING

FIG. 8 is a front elevation of a portion of an alternative embodiment, showing the pocket attached to a pack, but without the top flap or flap strap shown in FIGS. 1, 2, 5 and 7.

FIG. 9 is an isometric view of another alternative embodiment, showing a pocket similar to the pocket shown in FIG. 8 mounted on a fanny pack.

DETAILED DESCRIPTION OF THE PREFERRED EMBODIMENT

Figure 1:
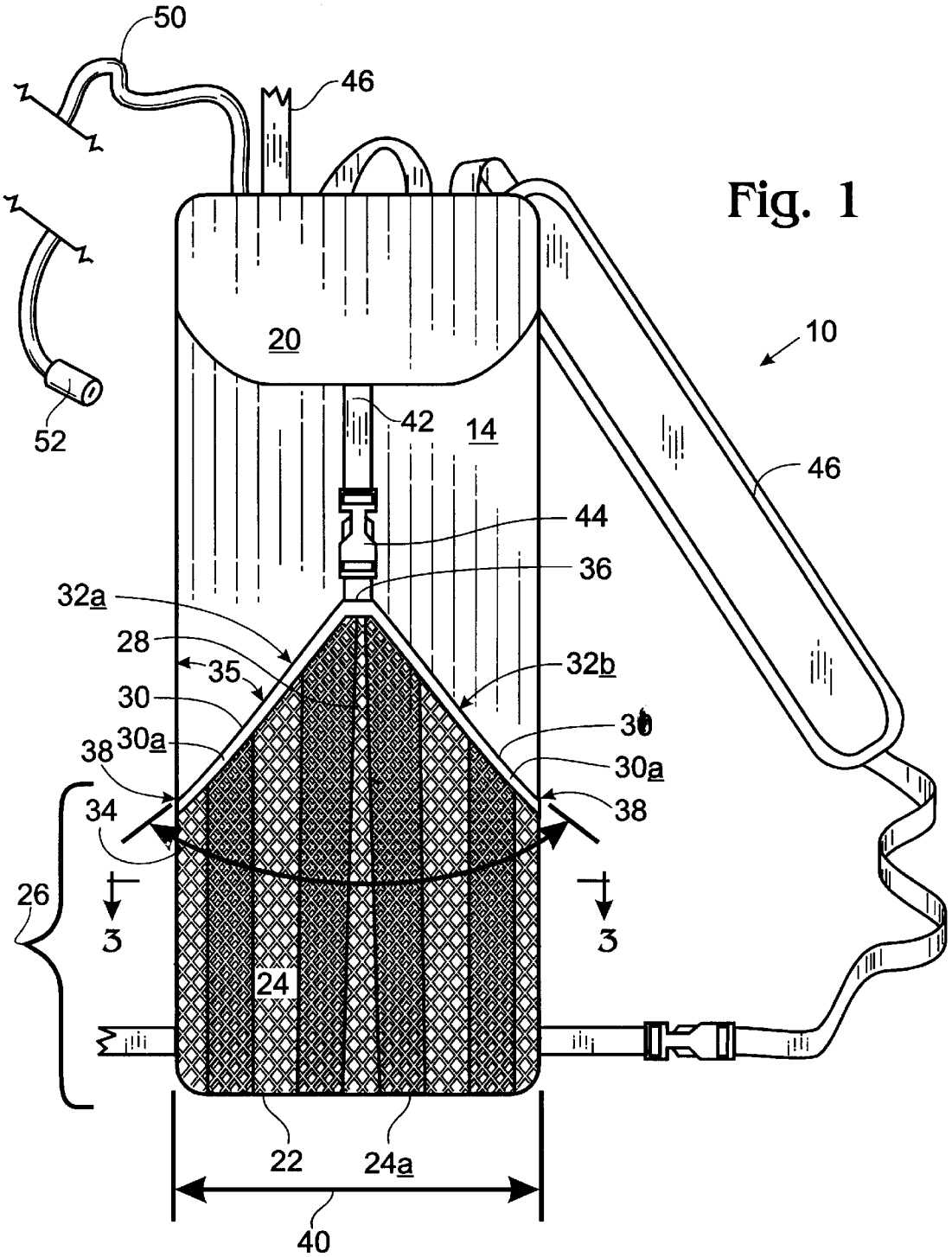
FIG. 1 is a front elevation of the preferred embodiment of the pack of the present invention.

In FIG. 1, a pack according to the preferred embodiment is indicated generally at 10 and further details of pack 10 also are shown in FIGS. 2–7, including a storage compartment 12 (see FIG. 5) defined by front 14 and a rear 16. Front 14 also forms an outer surface 14 of pack 10. Front 14 and rear 16 together define an open top 18 (see FIG. 5) of storage compartment 12. Preferably, a top flap 20 is attached to rear 16 adjacent open top 18. Top flap 20 may be extended over open top 18 to overlap at least a portion of front 14, thereby closing open top 18.

A pocket 22 is formed on outer surface 14 by pocket front 24, preferably made of mesh sheet material. Pocket front 24 is preferably pleated, with pleats indicated in FIG. 3 at 24*a*. Pocket front 24 includes a main body 26 and preferably an upwardly extending pocket flap 28.

Pocket flap 28 in turn includes one or more edges 30 that form upper edges or guides for pocket 22. Edges 30 are preferably constructed from elastic edging 30*a* wrapped around the perimeter of pocket flap 28. Edges 30 define an open entrance to pocket 22, preferably in the form of oppositely facing, sloped openings 32*a* and 32*b*, as shown best in FIG. 1.

In the preferred embodiment, pocket flap 28 is tapered so that edges 30 define an angle of taper 34, with edges 30 approximately converging to form a single apex 36. Angle of taper 34 may vary generally from 40-degrees to 140-degrees. A preferred measure of angle of taper 34 is approximately 100-degrees. As shown in FIG. 1, the slope of edge 30, indicated as angle 35, relative to the vertical, is about 50-degrees. However, a range of 20-degrees to 70-degrees has been found suitable for guiding a person's hand into pocket 22.

Instead of defining an apex 36, edges 30 may converge without meeting at an apex, or edges 30 may be parallel to define vertical openings. Neither of these options is shown in the drawings, as they are relatively self-explanatory. For reference, a point 38 indicates the point where pocket flap 28 is attached to storage compartment 12, and width 40 indicates the width of pocket flap 28 at point 38.

In FIGS. 1, 2, 5 and 7, a flap strap 42 incorporating a releasable buckle 44 is shown interconnecting top flap 20 and pocket flap 28. In an alternative embodiment of the pack, indicated at 110 in FIG. 8, the top flap, flap strap and buckle of the preferred embodiment are omitted. Apex 136 of pocket flap 128 is attached directly to outer surface 114. Furthermore, elastic edging 130*a* is extended beyond pocket flap 128 and formed into a loop 136*a* adjacent apex 136. Loop 136*a* may be used for attaching keys, cord, or various other accessories to pack 110.

As shown in FIG. 1, a strap 46, and preferably two straps 46 in the form of a pair of shoulder straps, allows pack 10 to be worn easily by a person. In yet another alternative embodiment, shown in FIG. 9 as pack 210, strap 246 is a hip belt, and pack 210 is in the shape of a fanny pack. Pocket 222 is configured similar to pockets 22 and 122 shown in FIGS. 1–8, providing the same easy access as in the embodiments of FIGS. 1–8. Loop 236*a* is a rigid ring, thus differing somewhat from elastic loop 136*a* shown in FIG. 8.

Figure 2:
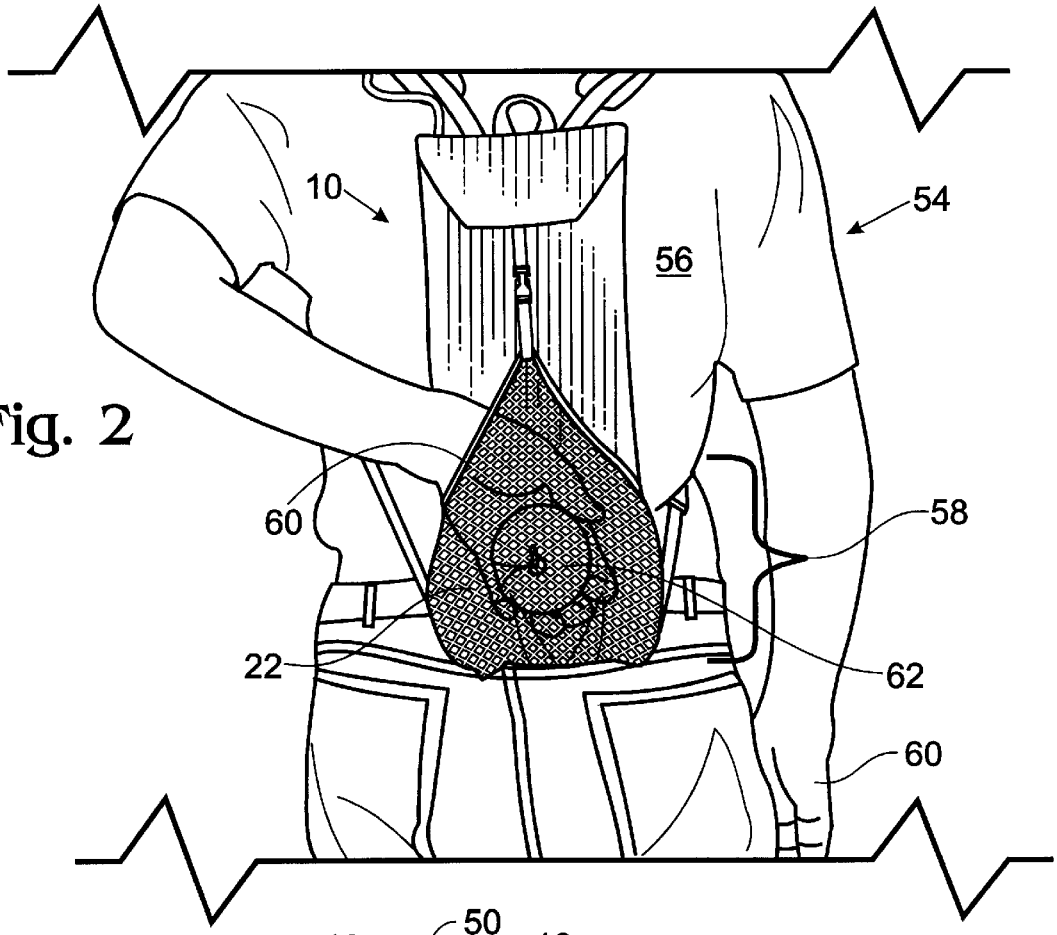
FIG. 2 is a front elevation of the pack of FIG. 1 being worn on a person's back, with the person reaching their left hand into the pocket to access an item., shown on a smaller scale than in FIG. 1.
Figure 3:
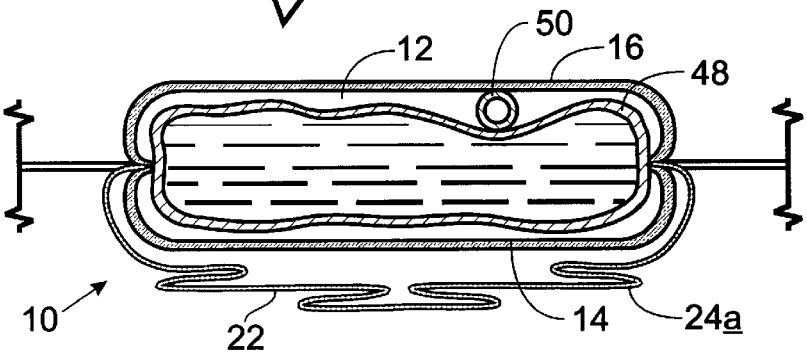
FIG. 3 is a top cross-sectional view of the pack shown in FIG. 1, taken along line 3—3 in FIG. 1, shown on the same scale as in FIG. 1.
Figure 4:
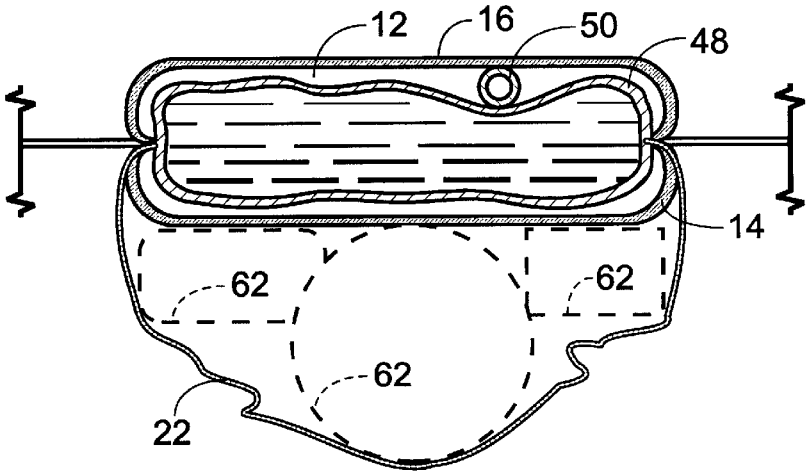
FIG. 4 is a top cross-sectional view similar to FIG. 3, but with the pocket expanded to hold various articles, and the articles shown in dashed lines.
Figure 5:
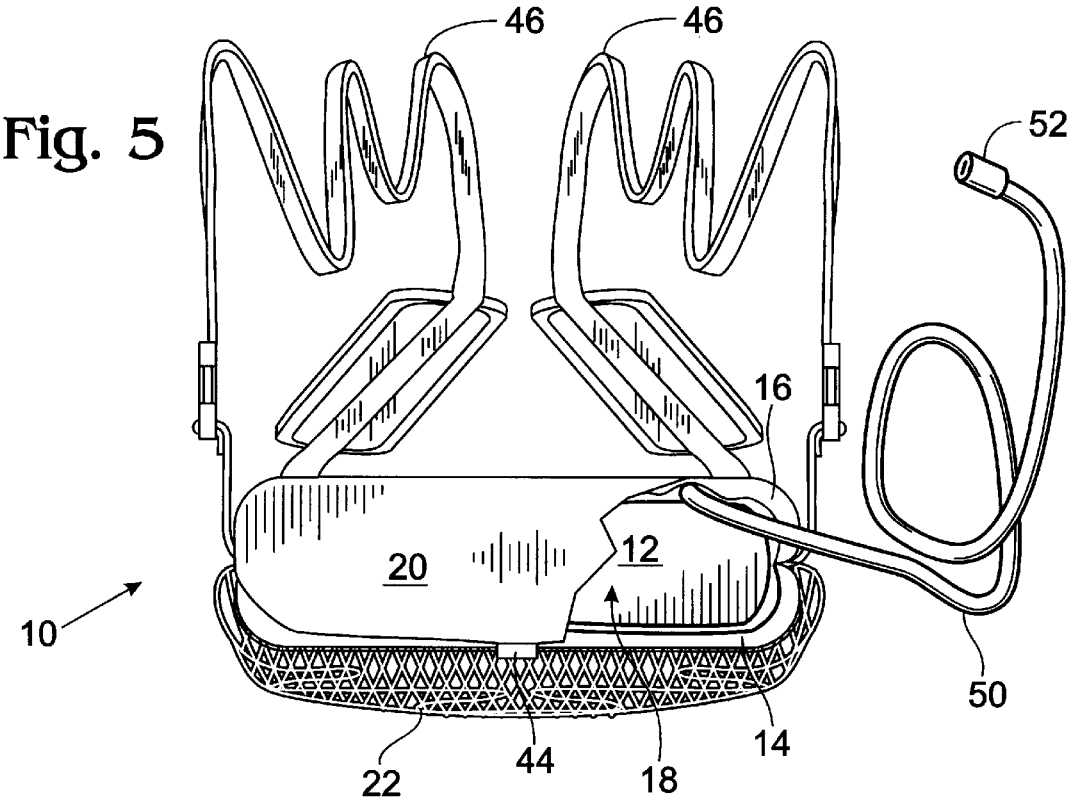
FIG. 5 is a top plan view of the pack shown in FIG. 1, with a portion of the top flap cut away to show an open top and storage compartment.
Figure 6:
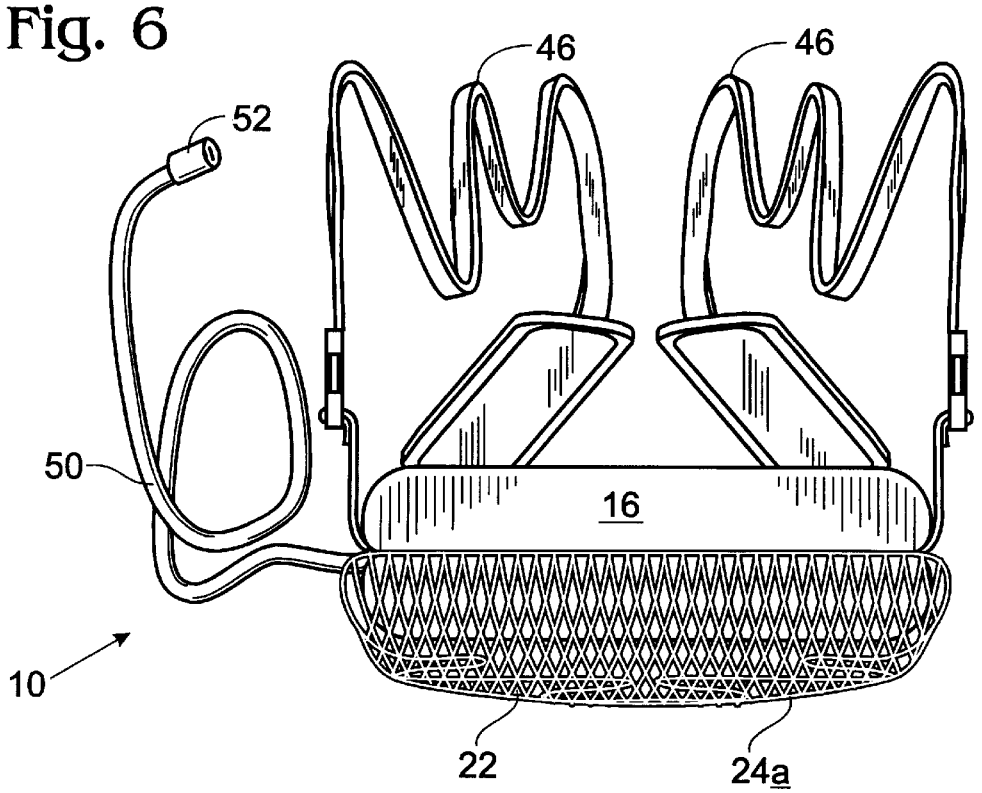
FIG. 6 is a bottom plan view of the pack shown in FIG. 1.
Figure 7:
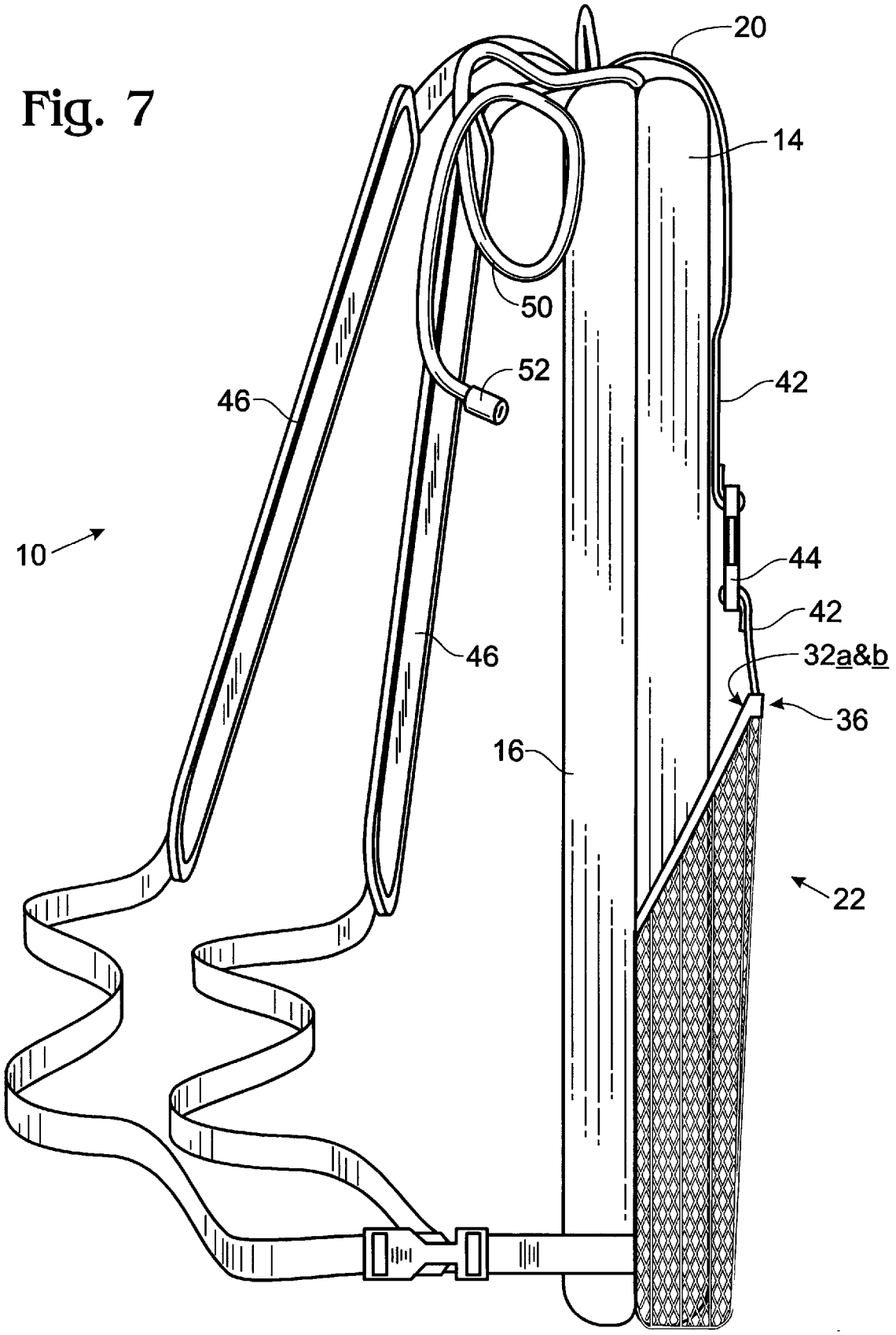
FIG. 7 is a left side elevation of the pack shown in FIG. 1.

A liquid-holding reservoir is indicated at 48 in FIGS. 3 and 4, with a tube 50 and attached mouth-activated valve 52 (FIGS. 1 and 5–7) to allow a person to drink liquid from reservoir 48. A person is indicated at 54 in FIG. 2, with the person's back 56, small of the back 58, and hands 60 being labeled accordingly. In FIGS. 2 and 4, articles held in pocket 22 are indicated at 62.

The arrangement of flexible pocket 22 of the present invention has several important advantages. First, the open entrance 32 defined by edges 30, arranged at a slope in the range of 50-degrees, provides a "touch point," or a readily locatable edge 30 that a person can touch or feel when reaching behind their back. Edge 30 serves to guide the hand, thereby facilitating access to the interior of pocket 22 and the contents of pocket 22. Additionally, by providing edges 30 sloped oppositely to one another, in the triangular form as shown in FIG. 1, a person easily can use their right or left hand to access the pocket 22 from either side of pack 10.

Sloped edges 30 provide ready access by one hand reaching behind the back, a very important advantage when one is riding a bicycle. In riding a bicycle, it is important to keep one hand on the handlebars. Now, with the present invention, the other hand can be used to access pocket 22 on pack 10.

While the present invention has been shown and described by reference to the preferred embodiment and selected alternative embodiments, it will be apparent to those skilled in the art that other changes in form and detail may be made therein without departing from the spirit and scope of the inventions defined in the appended claims.

I claim:

1. A pack for wearing on a person's back, comprising:

a front facing outwardly when the pack is worn;

a pocket attached to and extending at least partially across the front of the pack for overlying generally the small of the person's back when the pack is worn, the pocket including an open entrance defined by an upper edge oriented for readily being located by touch when the person reaches behind their back, thereby guiding and facilitating access into the pocket, and the pocket including an upwardly extending pocket flap that provides the upper edge of the pocket;

a storage compartment defined by the front and a rear, the compartment including an open top; and a top flap attached to the rear of the storage compartment adjacent the open top, extendable from the rear to the front of the compartment to close at least partially the compartment and overlap at least a portion of the front of the compartment, and operatively connected to the pocket flap so that the top flap is maintained in a closed position overlapping the front of the compartment while the pocket flap is maintained simultaneously in an upwardly oriented article-retaining position.

2. The pack according to claim 1, further comprising a flap strap interconnecting the top flap to the pocket flap.

3. The pack according to claim 2, wherein the flap strap includes a releasable buckle interposed the top flap and the pocket flap.

4. The pack according to claim 1, wherein the edge of the pocket is elastic.

5. A pack for wearing by a human, comprising:

an outer surface oriented to be approximately parallel to a person's back when the pack is worn by the person;

a pocket attached to and extending at least partially across the outer surface, the pocket including an upwardly extending pocket flap with edges that define oppositely facing openings;

a storage compartment defined by a front and a rear, the compartment including an open top, and the front of the compartment forming the outer surface of the pack; and a top flap attached to the rear of the storage compartment adjacent the open top, extendable from the rear to the front of the compartment to close at least partially the compartment and overlap at least a portion of the front of the compartment, and operatively connected to the pocket flap so that the top flap is maintained in a closed position overlapping the front of the compartment while the pocket flap is maintained simultaneously in an upwardly oriented article-retaining position.

6. The pack according to claim 5, further comprising a flap strap interconnecting the top flap to the pocket flap.

7. The pack according to claim 6, wherein the flap strap includes a releasable buckle interposed the top flap and the pocket flap.

8. The pack according to claim 5, wherein the edges of the pocket flap are elastic.

9. The pack according to claim 5, wherein the pocket flap tapers inwardly from a width that approximately conforms to the outer surface at a point where the pocket flap is attached to the outer surface.

10. The pack according to claim 5, wherein the edges of the pocket flap define an angle of taper.

11. The pack according to claim 10, wherein the angle of taper ranges from approximately 40-degrees to 140-degrees.

12. The pack according to claim 10, wherein the edges of the pocket approximately converge to an apex.

* * * * *